US008510868B2

(12) United States Patent
Mongan et al.

(10) Patent No.: US 8,510,868 B2
(45) Date of Patent: Aug. 20, 2013

(54) DUTY BELT SYSTEM

(76) Inventors: Ryan Mongan, Orange, CA (US); David Law, Seattle, WA (US); Graeme Esarey, Seattle, WA (US); Scott Comins, Seattle, WA (US)

( * ) Notice: Subject to any disclaimer, the term of this patent is extended or adjusted under 35 U.S.C. 154(b) by 14 days.

(21) Appl. No.: 13/154,284

(22) Filed: Jun. 6, 2011

(65) Prior Publication Data

US 2012/0198602 A1 Aug. 9, 2012

Related U.S. Application Data

(60) Provisional application No. 61/396,927, filed on Jun. 7, 2010.

(51) Int. Cl.
*A41F 9/00* (2006.01)
*A41F 19/00* (2006.01)
*A45F 5/00* (2006.01)

(52) U.S. Cl.
USPC ..... 2/312; 2/300; 2/311; 2/319; 224/195; 224/914

(58) Field of Classification Search
USPC ..... 2/300, 310, 312, 320, 338, 311, 319, 2/321, 322; 224/101, 191, 195, 660, 662, 224/663, 664, 665, 667, 673, 914
See application file for complete search history.

(56) References Cited

U.S. PATENT DOCUMENTS

| | | | | | |
|---|---|---|---|---|---|
| 775,149 | A * | 11/1904 | Righton | 224/195 |
| 1,642,046 | A * | 9/1927 | Sauer | 2/320 |
| 2,378,075 | A * | 6/1945 | Frecska | 340/321 |
| 3,868,786 | A * | 3/1975 | Lippe et al. | 446/28 |
| 5,226,195 | A * | 7/1993 | Pappas, Jr. | 2/338 |
| 5,722,576 | A | 3/1998 | Rogers | |
| 5,881,933 | A * | 3/1999 | Rogers | 224/195 |
| 6,015,073 | A * | 1/2000 | Wojciak et al. | 224/251 |
| 6,216,931 | B1 * | 4/2001 | Trawinski | 224/583 |
| 7,817,002 | B2 * | 10/2010 | Fullerton et al. | 335/306 |
| 2003/0110550 | A1 | 6/2003 | Guibord | |
| 2004/0226972 | A1 | 11/2004 | Cook | |
| 2009/0095785 | A1 * | 4/2009 | Woolery | 224/665 |

* cited by examiner

*Primary Examiner* — Amber Anderson
*Assistant Examiner* — Jameson Collier
(74) *Attorney, Agent, or Firm* — Maxvalveip LLC

(57) ABSTRACT

One example of the invention describes a belt that is to be used by uniformed professional field personnel (e.g. law enforcement, fire, park department, search and rescue, private security, utilities personnel, military, etc.). Some examples of the invention introduce many new features which allow for improved access, comfort, reliability, ruggedness and cosmetics. In one embodiment, the description describes a metal rail on a belt, to which accessories attach. The other items of the inventions are the details of the buckle and its various designs. Other attachments and accessories, plus various setups and arrangements for the belts and buckles, are also presented here.

10 Claims, 25 Drawing Sheets

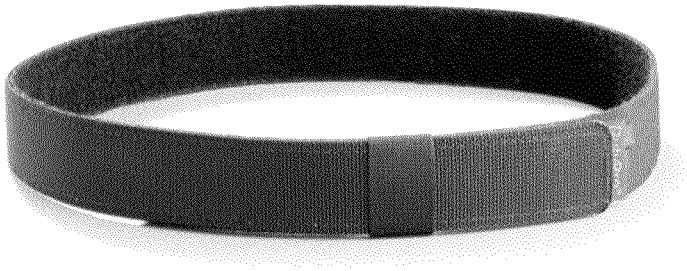
Figure 1. Typical inner belt.
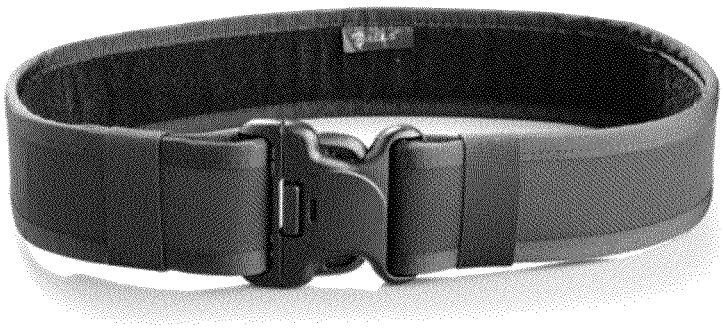
Figure 2. Typical duty belt.

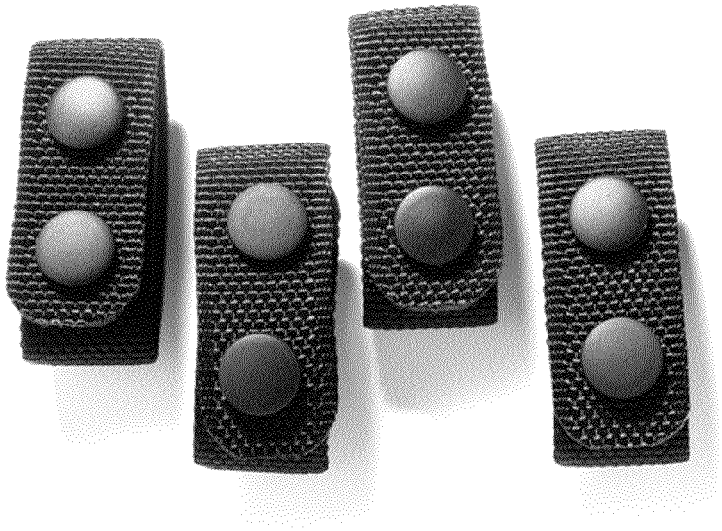
Figure 3. Typical keepers.
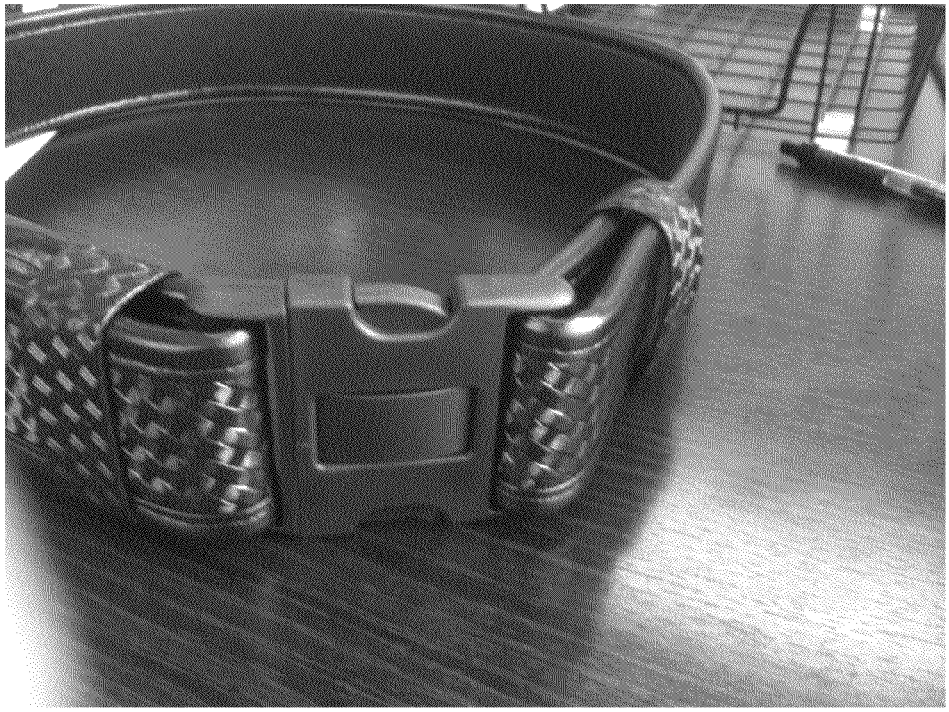
Figure 4a. Typical Fastex buckle duty belt.

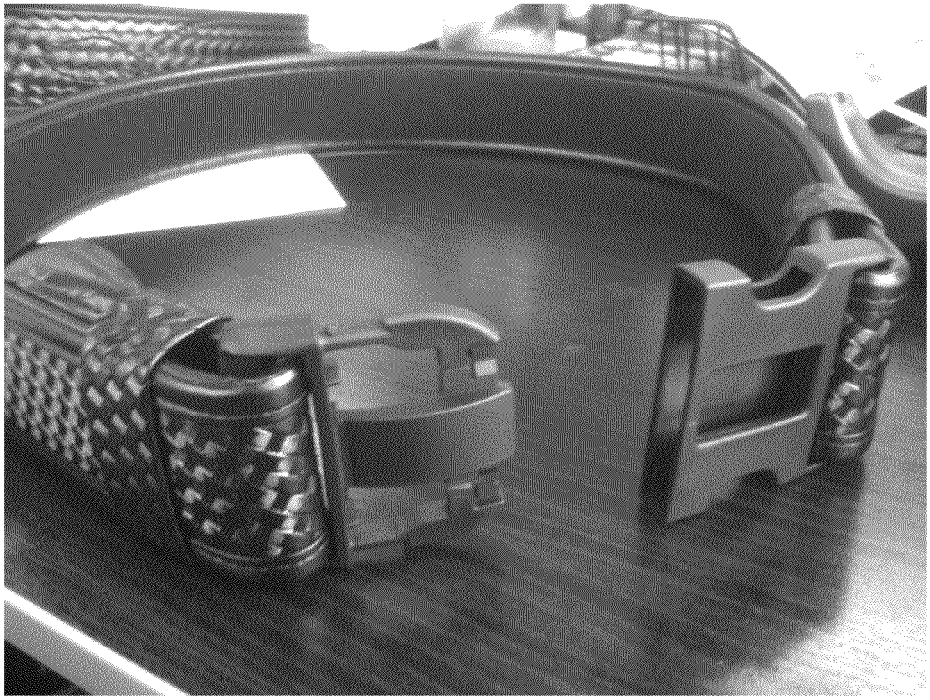
Figure 4b. Open duty belt.
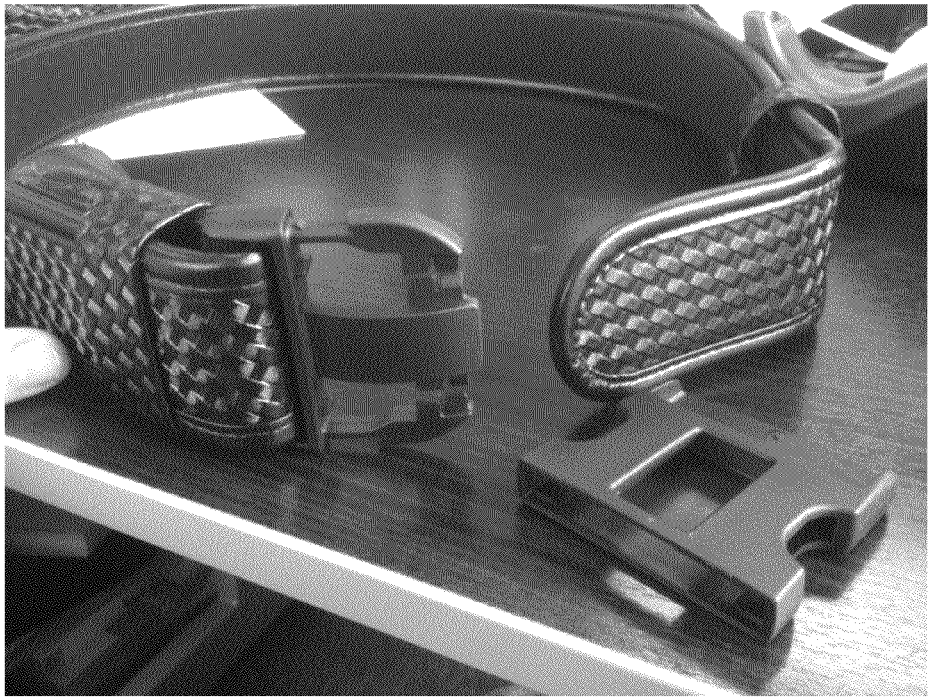
Figure 4c. Buckle removed on duty belt prior to sliding accessories on and off the belt.

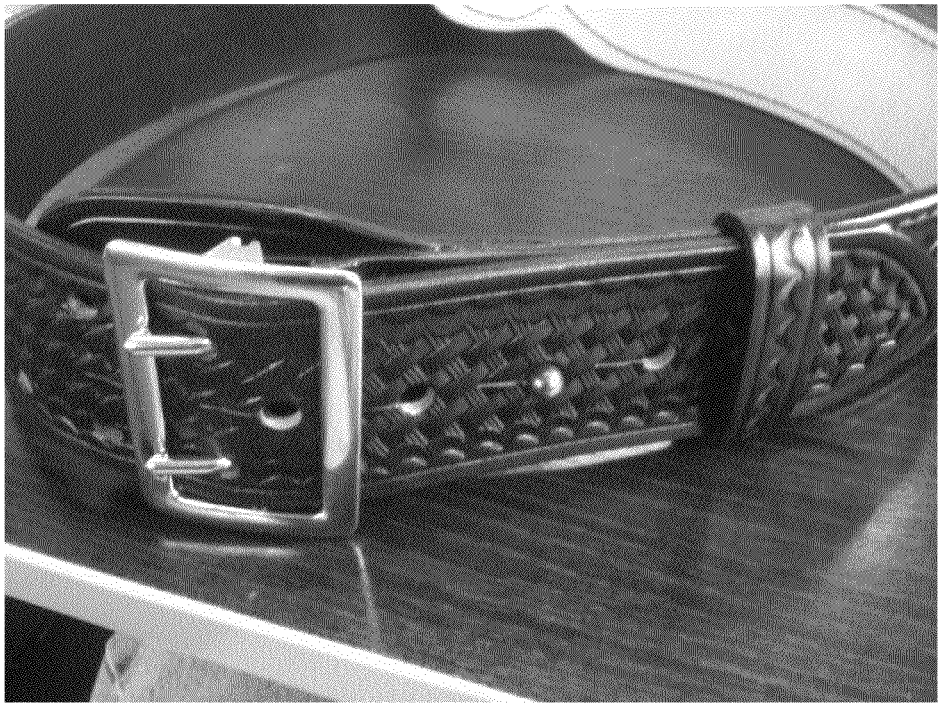
Figure 5a. Traditional buckle duty belt.
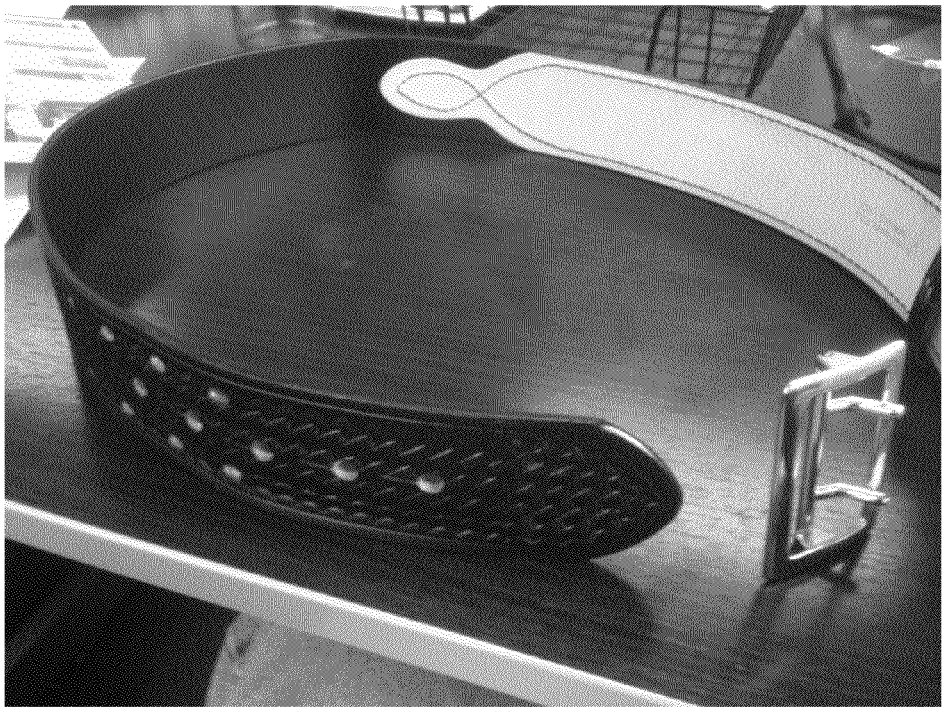
Figure 5b. Duty belt with removable buckle.

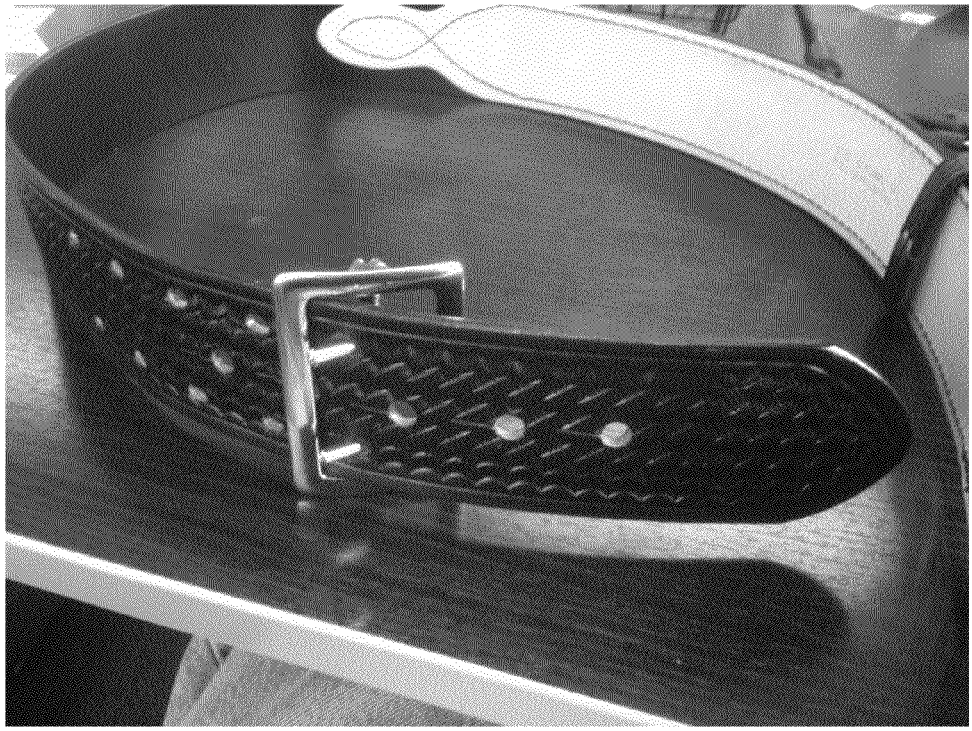
Figure 5c. Step 1 in assembling duty belt.
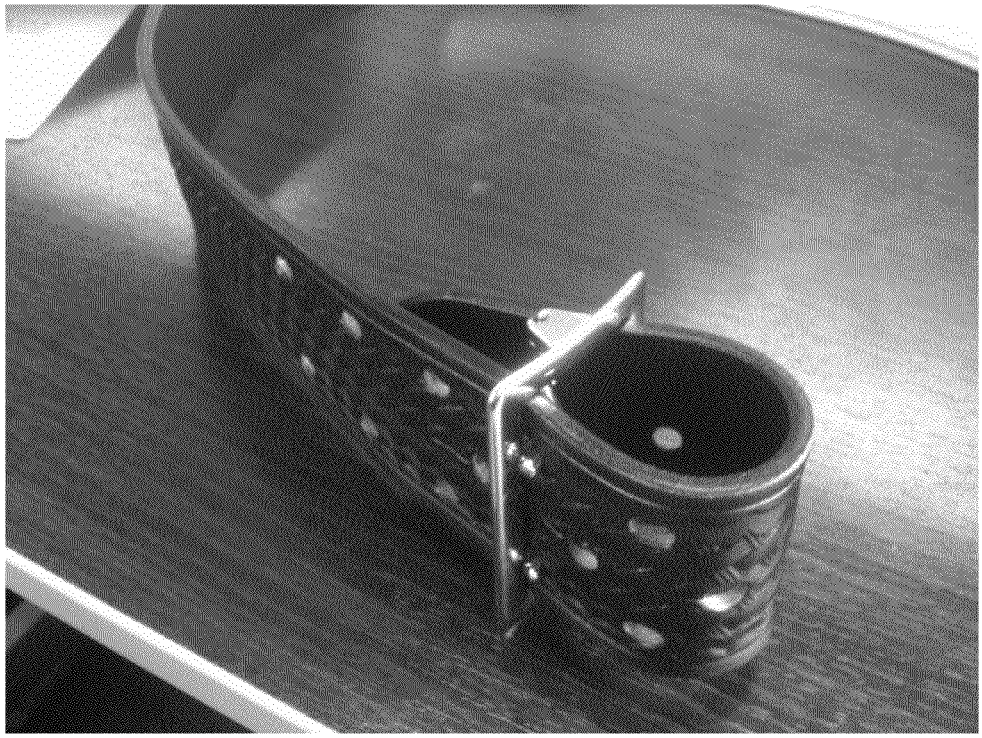
Figure 5d. Step 2 in assembling the duty belt.

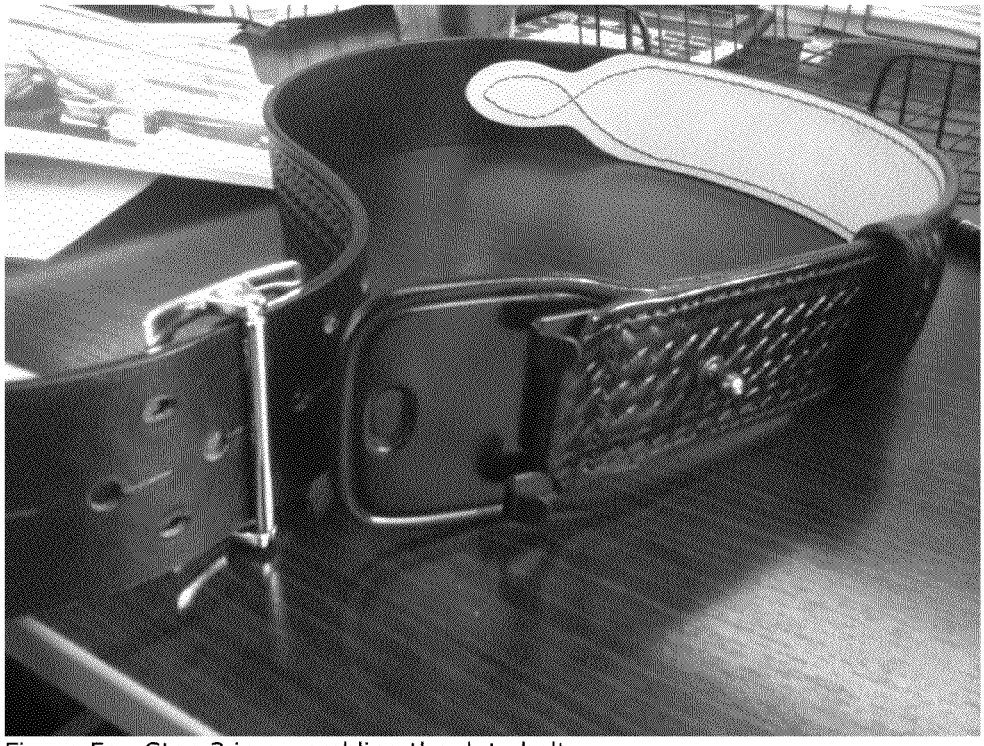
Figure 5e. Step 3 in assembling the duty belt.
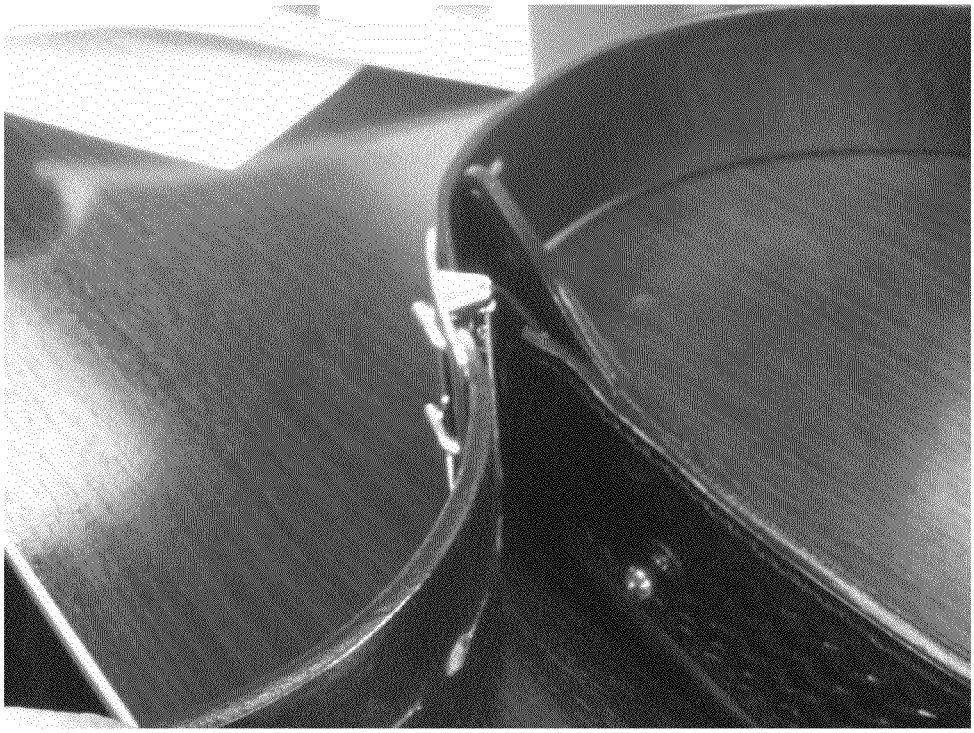
Figure 5f. Another angle of step 3 in the assembly of the duty belt.

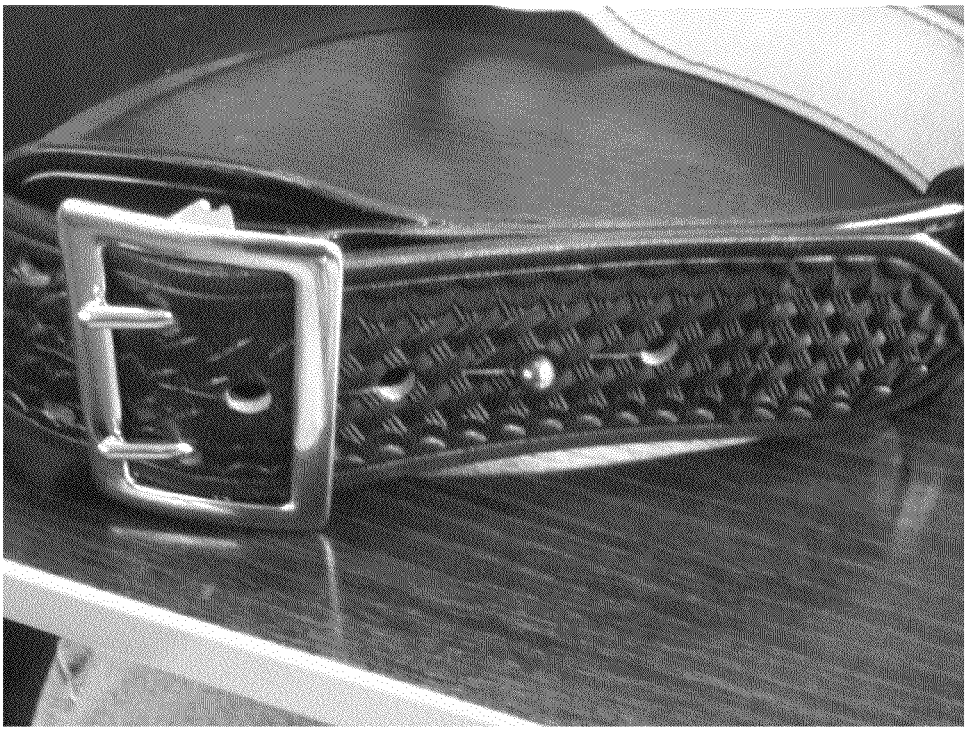
Figure 5g. Step 4 in the assembly of the duty belt.
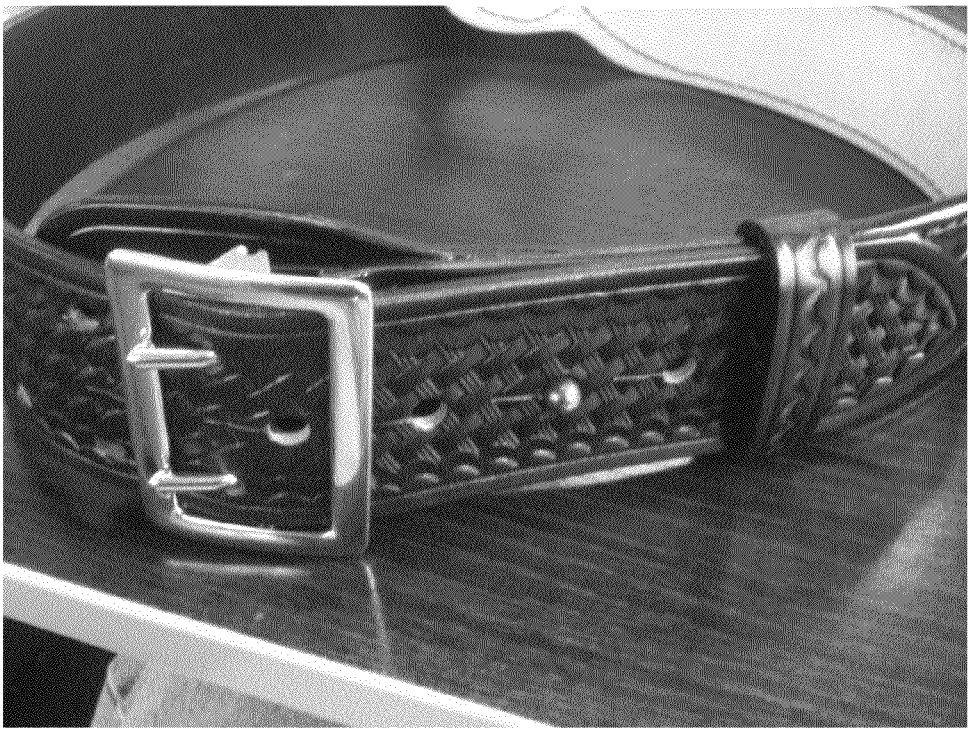
Figure 5h. Final step in assembly of duty belt.

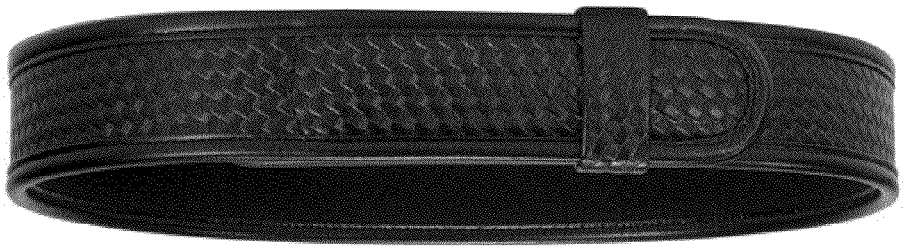
Figure 6. Buckleless duty belt.
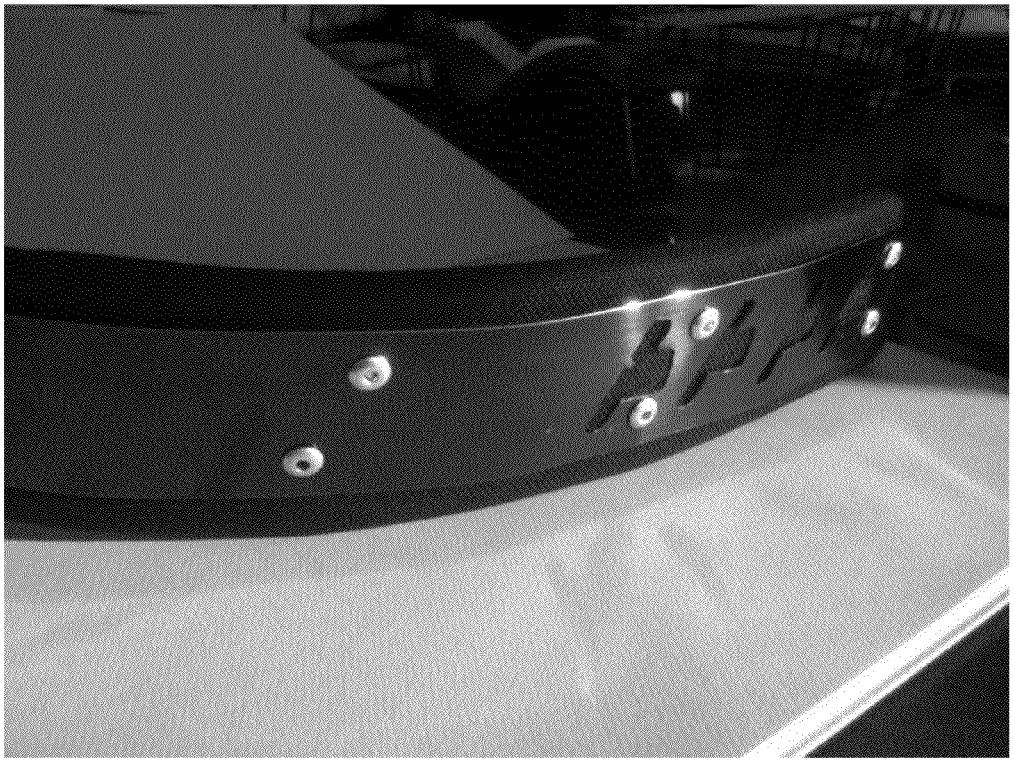
Figure 7. Integrated rail on present invention.

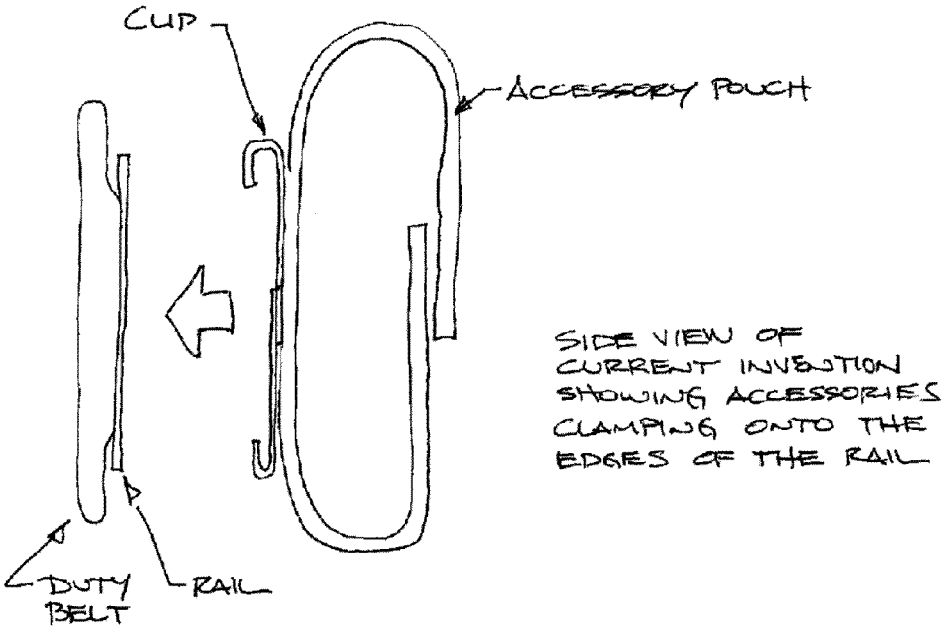
Figure 8. Cross section view of duty belt and mounted accessory
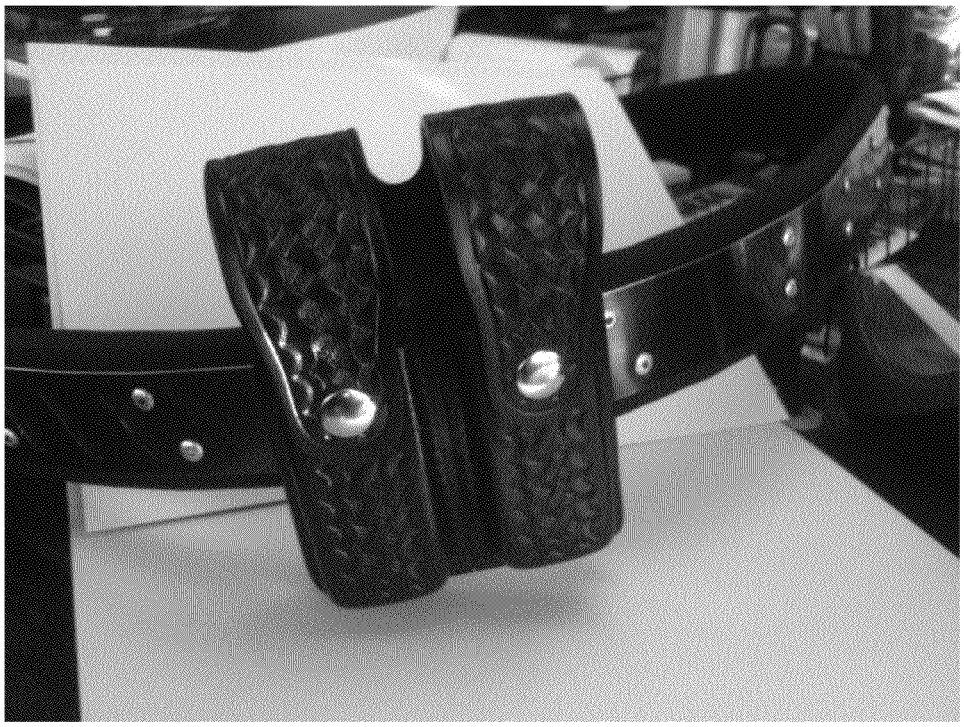
Figure 9a. Legacy accessory mounted to current invention (outside view).

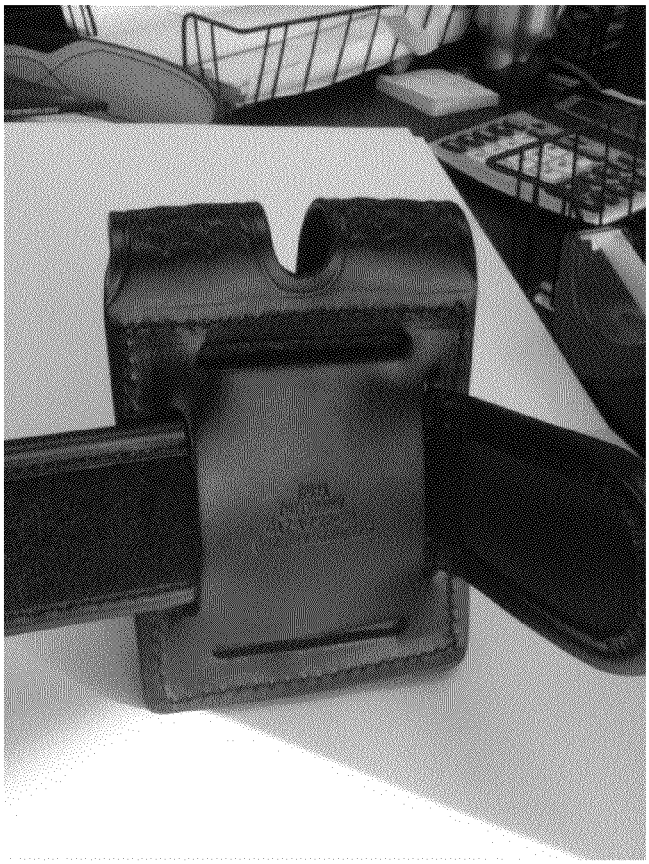
Figure 9b. Legacy accessory mounted to current invention (inside view).
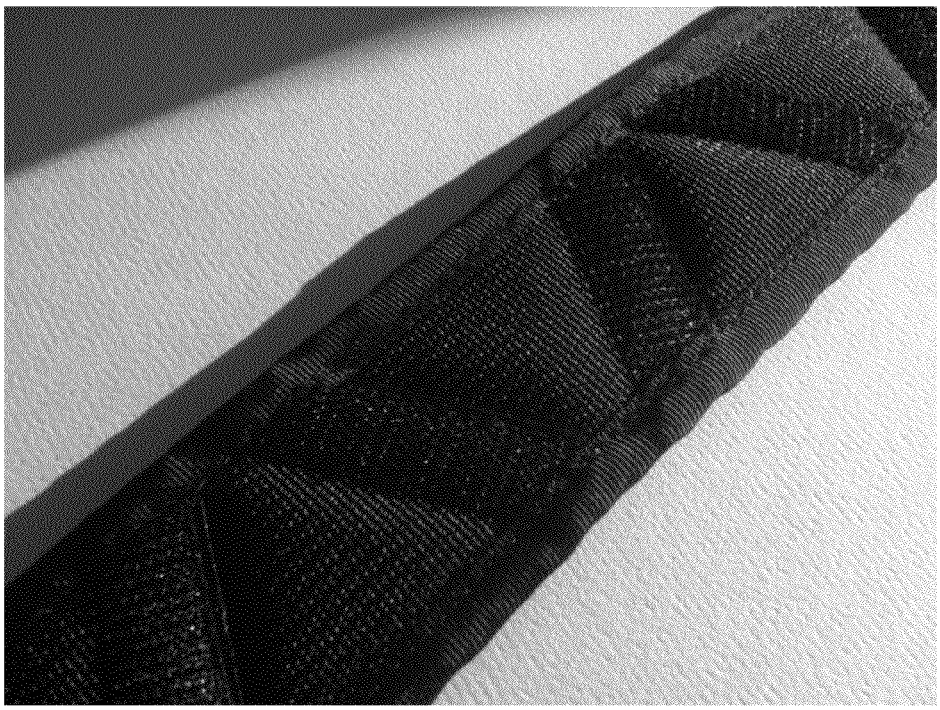
Figure 10. Inside of duty belt.

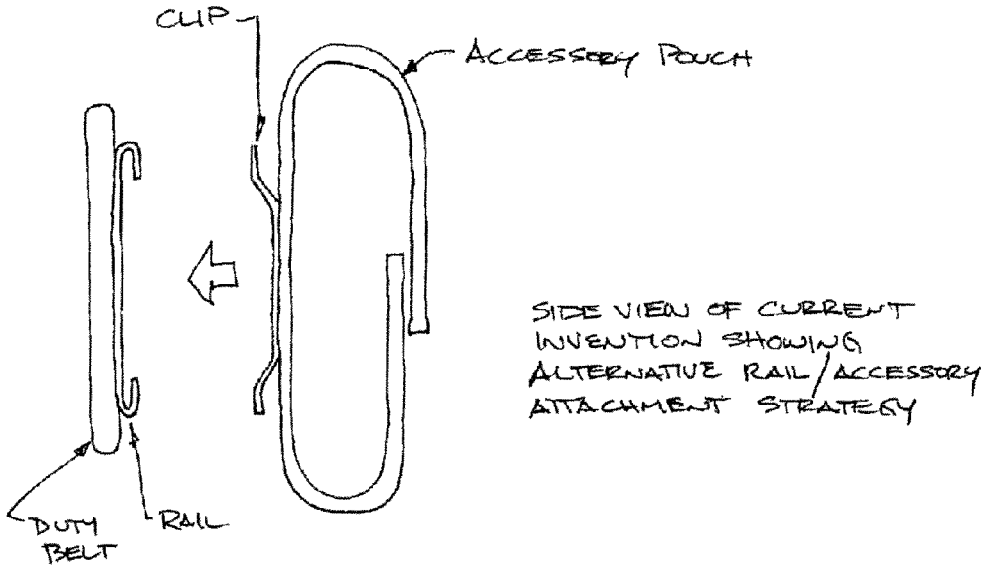
Figure 11. Alternative rail configuration

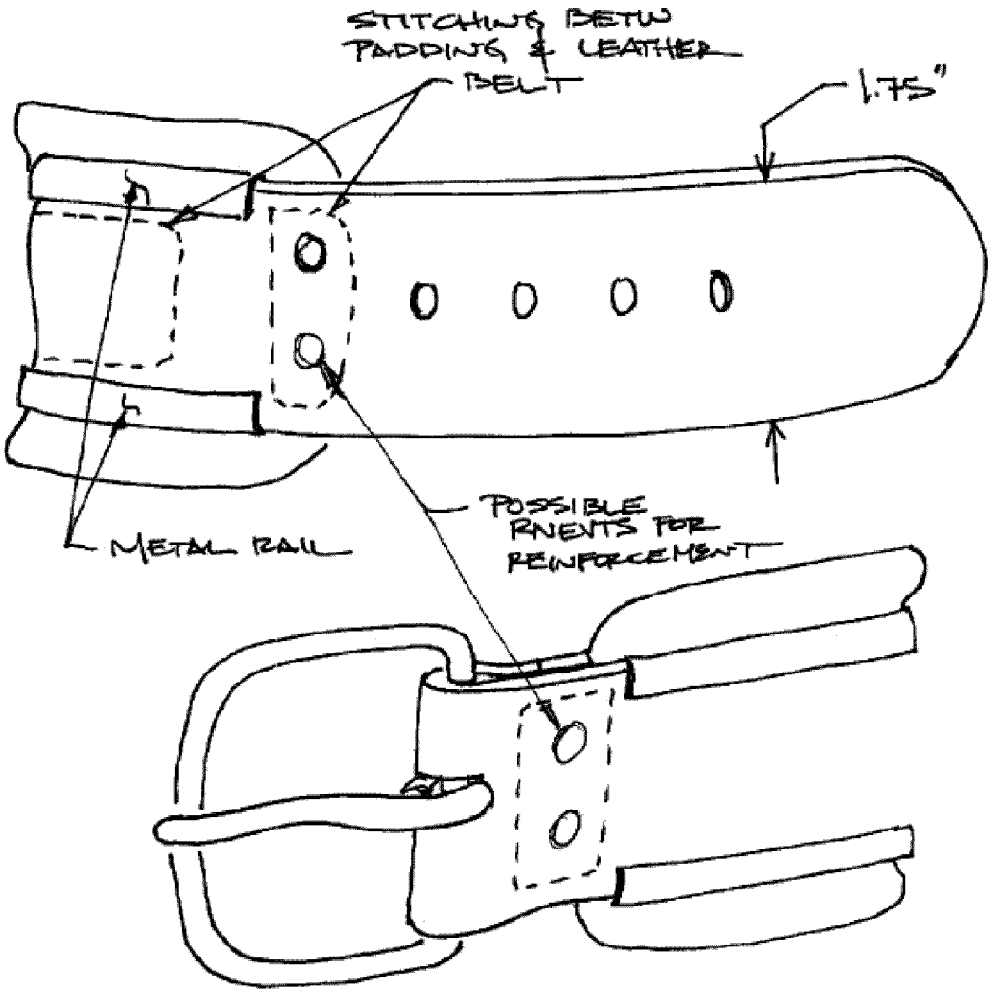
Figure 13. Cosmetic piece is extended to form traditional belt ends.

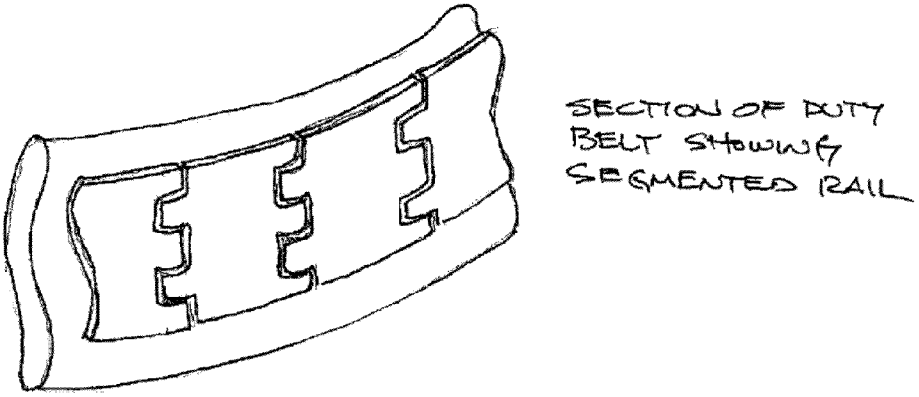

Figure 14. Segmented rail.

RAIL CAN BE PRE-FORMED INTO SHAPE
PRIOR TO ASSEMBLY

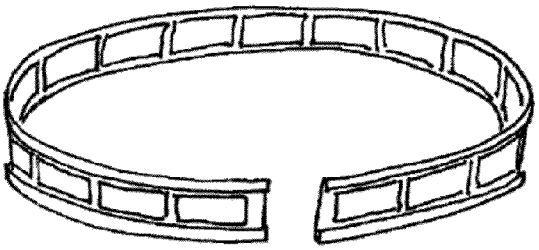

- ▷ WITHOUT THIS THE RAIL MIGHT HAVE A TENDENCY TO KINK WHEN PUTTING IT ON
- ▷ ALLOWS / DEMANDS UNIQUE POP DISPLAY WHICH SEPARATES IT FROM OTHER BELTS
- ▷ ALLOWS FOR MARKETING DISTINCTIONS — "PEOPLE AREN'T FLAT — BELTS SHOULDN'T BE"
- ▷ FIRST STEP IN A PLATFORM WHERE THE RAIL IS ANGLED AS YOU MOVE AROUND THE BODY

Figure 15. Pre-formed rail.

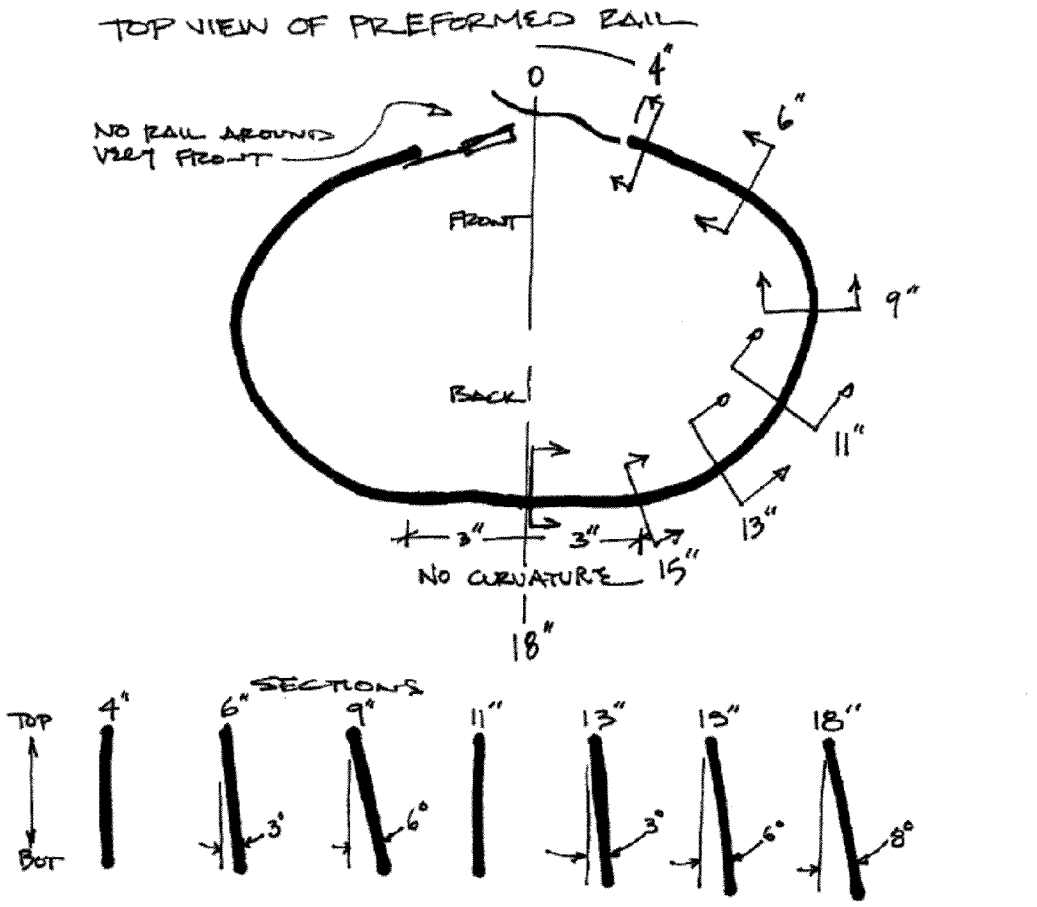
THE BOTTOM OF THE RAIL FLARES OUT TO MATCH BODY CONTOURS. THESE NUMBERS WERE TAKEN OFF ME.
THE PADDING COULD ALSO CHANGE AS YOU TRAVEL AROUND THE BODY. ← IN ORDER TO SPREAD OUT THE HOT SPOTS (PELVIC BONES).
Figure 16. Pre-formed rail with a variety of curvatures and flaring.

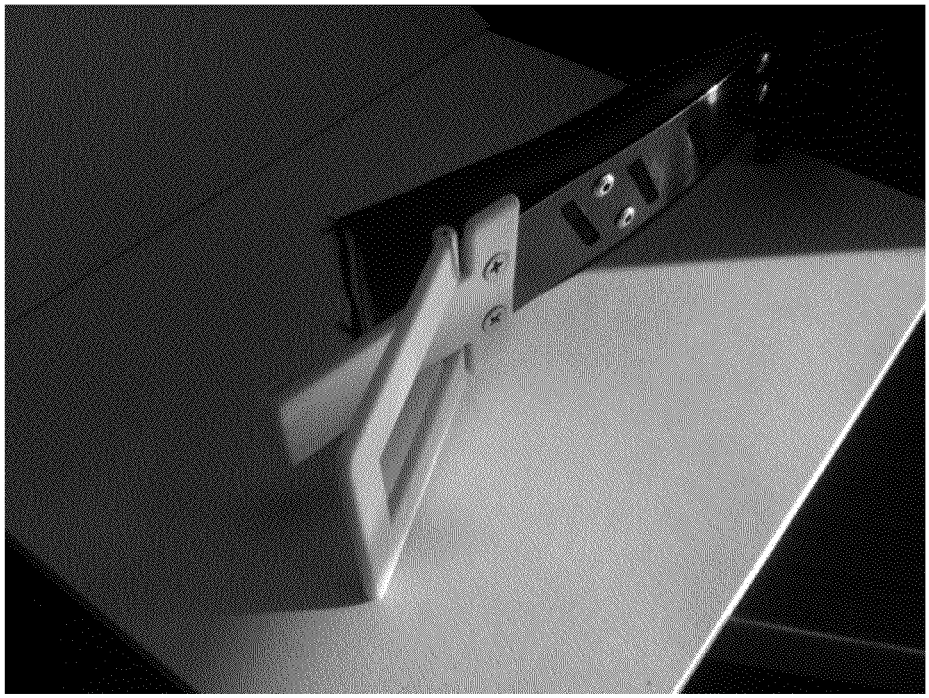
Figure 17a. Alternative buckle design.

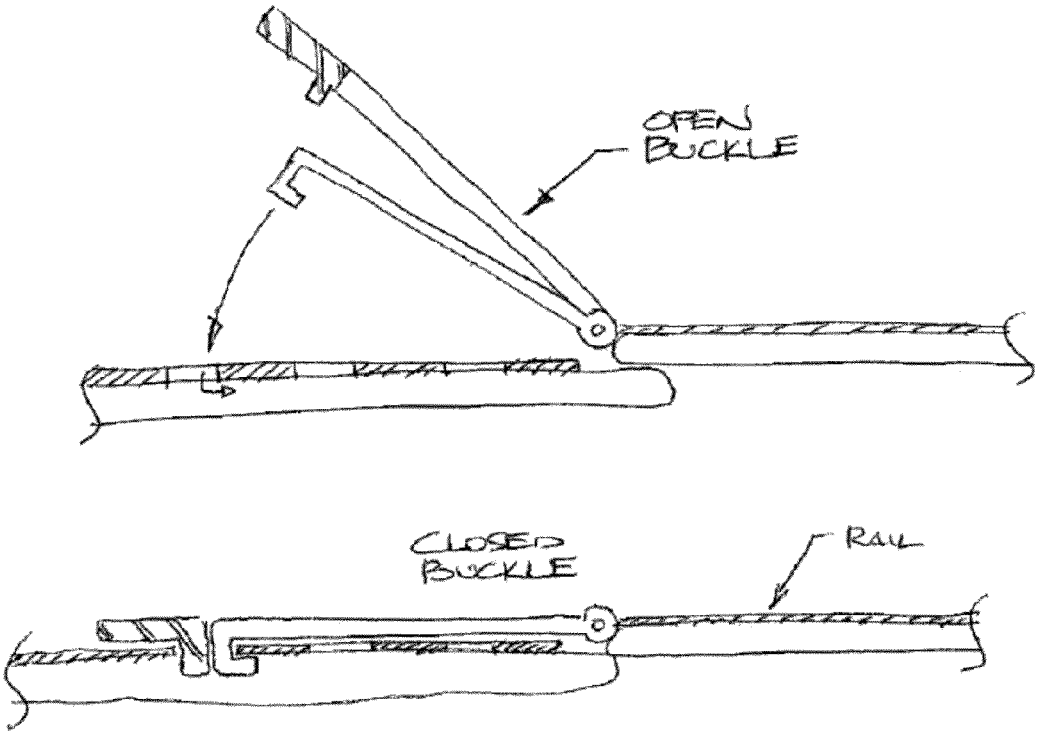
Figure 17b. Alternative buckle in open and closed position (cross section from above)

DUTY BELT SYSTEM

RELATED APPLICATIONS

The current application is related to (continuation of) a prior provisional application Ser. No. 61/396,927, filed on Jun. 7, 2010, with the same inventors and assignee, and similar title, taking benefits of all teachings and earlier filing date of that application.

BACKGROUND OF THE INVENTION

There is a need for better gear for law enforcement. The convenience, weight, security, stability, longevity, flexibility, and versatility are some of the factors that can be improved for the operation of the law enforcement officers, which are mission critical.

Duty Belts, as they are known in the industry, have been available for some time. The most common configuration is the following: The user has an inner belt (also known as a trouser belt) that is threaded through the belt loops of the user's pants (FIG. 1). Commonly, these do not incorporate a buckle in order to keep the profile as thin as possible. They also usually have one half of a Velcro assembly on the outward facing surface. Outside of the inner belt is the duty belt (also known as a Sam Brown belt by US law enforcement) itself (FIG. 2). This is a wider belt (typically 2" or 2.25" wide) and lies across the inner belt outboard of the pant belt loops. The duty belt is secured to the user by means of the other half of the Velcro assembly facing inwards toward the inner belt.

Sometimes, supplemental mechanical straps, known as "keepers", are used that wrap around both inner and duty belts to ensure that they are firmly attached to one another (FIG. 3). Still on other belts, there is no Velcro used at all between the inner and the duty belt. The keepers are the sole retention mechanism between the two belts in that configuration.

SUMMARY OF THE INVENTION

One embodiment of the invention describes a belt that is to be used by uniformed professional field personnel (e.g. law enforcement, fire, park department, search and rescue, private security, utilities personnel, military, etc.). One embodiment of the invention introduces many new features which allow for improved access, comfort, reliability, ruggedness and cosmetics.

It is important that the duty belt does not become separated inadvertently. All of the field professional's gear is attached to this belt. In the case of law enforcement this includes the officer's sidearm holster. The weight of some of these assemblies can exceed 20 pounds. If the belt were to come detached inadvertently, devices could become damaged. More critical to this is the danger of the law enforcement officer becoming separated from his or her sidearm or handcuffs during a physical altercation with a suspect. Care is taken with the duty belt buckle in order to minimize this risk. The duty belt buckles are executed in several different ways, each with their own pros and cons.

In the first set of embodiments, we have at least two distinct classes of inventions described here. In one embodiment, the description describes a metal rail on a belt, to which accessories attach. This is one of the main inventions. The other items of the inventions are the details of the buckle and its various designs (presented here). Other attachments and accessories, plus various setups and arrangements for the belts and buckles are also presented here.

BRIEF DESCRIPTION OF THE DRAWINGS

Some examples and embodiments are described here for clarification, but the inventions are not limited to these examples:

FIG. 1 shows a typical inner belt.

FIG. 2 shows a typical duty belt.

FIG. 3 shows typical keepers.

FIG. 4*a* shows a typical Fastex buckle duty belt.

FIG. 4*b* shows an open duty belt.

FIG. 4*c* shows a buckle removed on duty belt prior to sliding accessories on and off the belt.

FIG. 5*a* shows a traditional buckle duty belt.

FIG. 5*b* shows a duty belt with removable buckle.

FIG. 5*c* is the Step 1 in assembling duty belt, as one example.

FIG. 5*d* is the Step 2 in assembling duty belt, as one example.

FIG. 5*e* is the Step 3 in assembling duty belt, as one example.

FIG. 5*f* shows another angle of step 3 in the assembly of the duty belt, as one example.

FIG. 5*g* shows the Step 4 in the assembly of the duty belt, as one example.

FIG. 5*h* shows the final step in assembly of the duty belt, as one example.

FIG. 6 shows a buckleless duty belt.

FIG. 7 shows an integrated rail on present invention, as an example.

FIG. 8 shows a cross section view of duty belt and mounted accessory.

FIG. 9*a* shows a legacy accessory mounted to one of the current inventions (outside view).

FIG. 9*b* shows legacy accessory mounted to current invention (inside view), as an example.

FIG. 10 shows the inside of a duty belt, as an example.

FIG. 11 shows an alternative rail configuration.

FIG. 13 shows a cosmetic piece is extended, to form traditional belt ends.

FIG. 14 shows a segmented rail.

FIG. 15 shows a pre-formed rail.

FIG. 16 shows a pre-formed rail with a variety of curvatures and flaring.

FIG. 17*a* shows an alternative buckle design.

FIG. 17*b* shows an alternative buckle in open and closed position (cross section from above), as an embodiment of the invention.

DETAILED DESCRIPTION OF THE PREFERRED EMBODIMENTS

Figure 12:
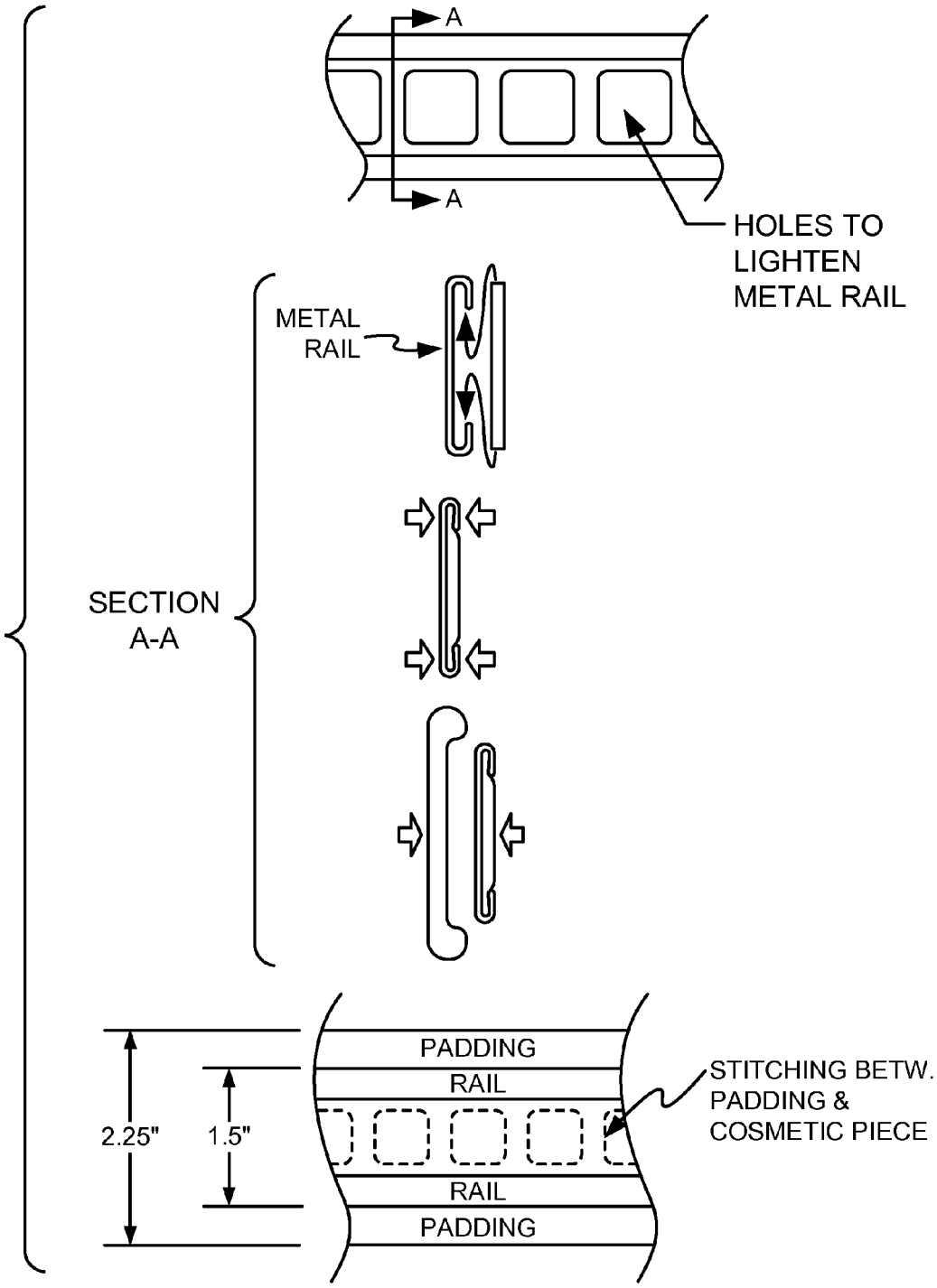
FIG. 12 shows a cosmetic piece attached in the interior of the rail.

The duty belts and buckles are executed in several different ways, each with their own pros and cons, as described below:

Some (FIG. 4*a*) utilize a Fastex type buckle that requires two steps in order to release. The version in FIG. 4*a* must have the center button pressed prior to squeezing the opposing buttons on either edge of the buckle. Even though there are only two steps, this is marketed as a 3-way retention, which is the standard and a positive selling feature in the market. The belt material itself threads through the Fastex buckle before it is attached back to itself, utilizing Velcro. Only the plastic buckle needs to be separated in order for the field professional to remove the duty belt (FIG. 4*b*). However, the connection between the belt and the buckle needs to be undone by the user, each time a new device is either threaded onto or off of the belt (FIG. 4*c*). The downsides of this assembly are:

The belt assembly is quite thick near the buckle as the belt is threaded through the buckle and folded back onto itself (~25 mm thick).

Belt accessories cannot be placed near the buckle because of interference with the folded-over-belt material.

In order to thread on belt accessories, the buckle is separated from the belt resulting in loose parts that can be dropped and lost.

The free slider that is used to retain the folded over at the end of the belt must first be removed, before accessories are put on. This results in more loose parts. It is also prone to errors for users who do not frequently reconfigure their belts.

The benefits of this buckle design are:

Even though it is 3-way retention, it only takes two motions to take the belt on and off.

Accessories can be threaded on and off, of either end of the belt.

Another popular style of duty belt is shown in FIG. 5*a*. This also has a 3-way retention mechanism and, cosmetically, shows itself as a more traditional belt design with a buckle. The buckle itself is actually removable (FIG. 5*b*), and it is required to remove it, in order to thread on and off the belt accessories. In order to assemble the belt, the buckle is slid onto the belt (FIG. 5*c*), and the buckles prongs engaged with the belt. Next, the end of the belt is threaded through the other half of the buckle (FIG. 5*d*). Now, the central bar on the buckle can engage with the prongs on the distal end of the belt (FIGS. 5*e* and 5*f*). To achieve the second level of retention, a stud which is integrated on the hook end of the belt is pressed through a hole on the buckle end of the belt (FIG. 5*g*). Finally, to get the third level of retention, a sliding keeper is moved over the free end of the belt (FIG. 5*h*).

The disadvantages of the belts described in FIGS. 5*a*-5*h* are:

There are many steps required in order to get the belt ready to slide on and off accessories, as the buckle needs to be removed.

Once removed, the buckle is a loose part, that may become lost.

Accessories may only be slid on and off, of one end of the belt, as the other end is too thick.

The belt assembly is thick beneath the buckle, when worn (~25 mm thick).

Advantages of this buckle design are:

Accessories may be placed close to the buckle on one side—the end of the belt with the buckle on it. The extending loose end of the belt prevents accessories being placed near the buckle on the other side of the buckle.

In its thickest part (under the buckle) it is similar in thickness to the Fastex belt, however, this thickness only occurs at one point where in the Fastex option, it occurs in two locations, one on either side of the buckle.

Since the sliding keeper is on the end of the belt, which does not have accessories sliding on and off, it does not have to be removed from the belt in order to configure the belt (as opposed to the Fastex version).

Another type of duty belt is a buckleless duty belt (FIG. 6). Other than cosmetics, this is equivalent in many ways to the belt detailed in FIGS. 5*a*-5*h*. Both have a free sliding keeper and a retaining stud. Instead of the hooks engaging with the back of the buckle, this version has Velcro between the two ends. Other buckleless belts have a sliding keeper, Velcro and a hidden metal hook and loop, in order to achieve three levels of retention.

The disadvantages of the buckleless belts are:

Accessories cannot be placed near the center front of the belt because of the overlapping belt.

Accessories can only slide on and off from one end of the belt because of interference with either the previously mentioned stud or the hidden hooks.

From a cosmetic standpoint, the buckleless designs are lacking a strong visual element of the buckle. Buckles live on the line of symmetry. The visual elements on the buckleless design live off-center.

Advantages of the buckleless design are:

It has the lowest profile of any of the existing systems.

There are no loose parts when sliding on and off accessories.

One embodiment of the current invention incorporates a rigid or semi-rigid rail mounted on the exterior of the duty belt (FIG. 7). The version shown is fabricated from thin sheet metal, but polymers could also be used. Instead of sliding accessories onto the belt from one of the ends, the accessories clip onto the rail (FIG. 8). Legacy accessories (those designed for the prior generation of duty belts) can still be utilized as they slide onto the belt in the traditional method (FIGS. 9*a* and 9*b*).

The inner surface of the duty belt can have either of the current state of the art surface treatments (½ of a Velcro (hook-and-loop fastener) assembly or no Velcro at all, with the intention of being retained by keepers only). It could also utilize a new surface treatment, as shown in FIG. 10. This has one half of the Velcro assembly, but only on a portion of the interior surface. This has two advantages. First it uses less Velcro, which is an expensive component. Secondly, where the Velcro is not present, mesh or perforations can be added to the belt in order to aide in breathability. The current belts are significantly wide (as previously mentioned) and made of impermeable materials. This combination can cause the users to sweat under the belt when worn for a prolonged period of time.

In addition to a flat rail, the rail can be shaped. This can allow for alternative mounting techniques (FIG. 11). It also can allow for a cosmetic piece to be affixed on the interior of the rail (FIG. 12). Notice that the rail can be perforated to make it lighter and to aide in breathability. This cosmetic piece can also be extended and become integral with the ends of the belt (FIG. 13).

In the above description, the rail is shown to be continuous. It could also be interrupted to allow for several rails to be attached around the belt. In addition, it could also be segmented (FIG. 14). Both of these alternatives allow for a belt that is very easy to bend around the body. Belts like these can be shipped and displayed flat, as is for the current practice. (Note that FIG. 14 shows an articulating or segmented rail.)

Another alternative is that the rail is pre-formed prior to assembly (FIG. 15). In this manner, it can be shaped to fit a person. The advantage in this is that the load of the duty belt can be more evenly distributed around the user's waist.

The pre-formed rail can be taken a step further (FIG. 16) by not just curving it into a round cross section. The cross section of a person at the waist is not round and the rail (and therefore the duty belt as an assembly) can match the shape of an individual. An example of this is across the small part of the back of a person, where there is very little, if any, curvature. Another improvement is that the rail could have flaring (or even variable flaring) (also in FIG. 16), as the rail travels around the body. For example, across the pelvic bones, the lower edge of the rail (closer to the ground) could flare outward, while closer to the stomach the upper edge of the rail could flare outward.

With the rail, other buckle systems can be employed that are not possible with the current soft material belt. One of these utilizes a two part buckle (FIGS. 17*a* and 17*b*). The center portion of the buckle tabs into a perforation in the rail. The outer portion then pivots into place, preventing the center portion from backing out. A sliding keeper over the buckle would then represent the third layer of retention.

The above described embodiments can utilize any of the current state of the art buckles. In all of these, this invention has the distinct advantage when it comes to configuring the belt with accessories. Not only are there no loose parts during configuration, but the belt does not even have to be taken off the body. Plus, an accessory in the middle of the belt can be removed and replaced without disturbing any of the other accessories. And, since the rail can be taken right up to the buckle, accessories can be attached to the front of the belt, where it is impossible to attach them with the current solutions. This is especially striking with the buckleless system. In this, the rail can be taken right to the end of the belt, so that accessories can be mounted around the entire perimeter of the person. For some field professionals with a significant amount of accessories (e.g. law enforcement) and for some people with a small belt circumference, this is a striking advantage.

Figure 18:
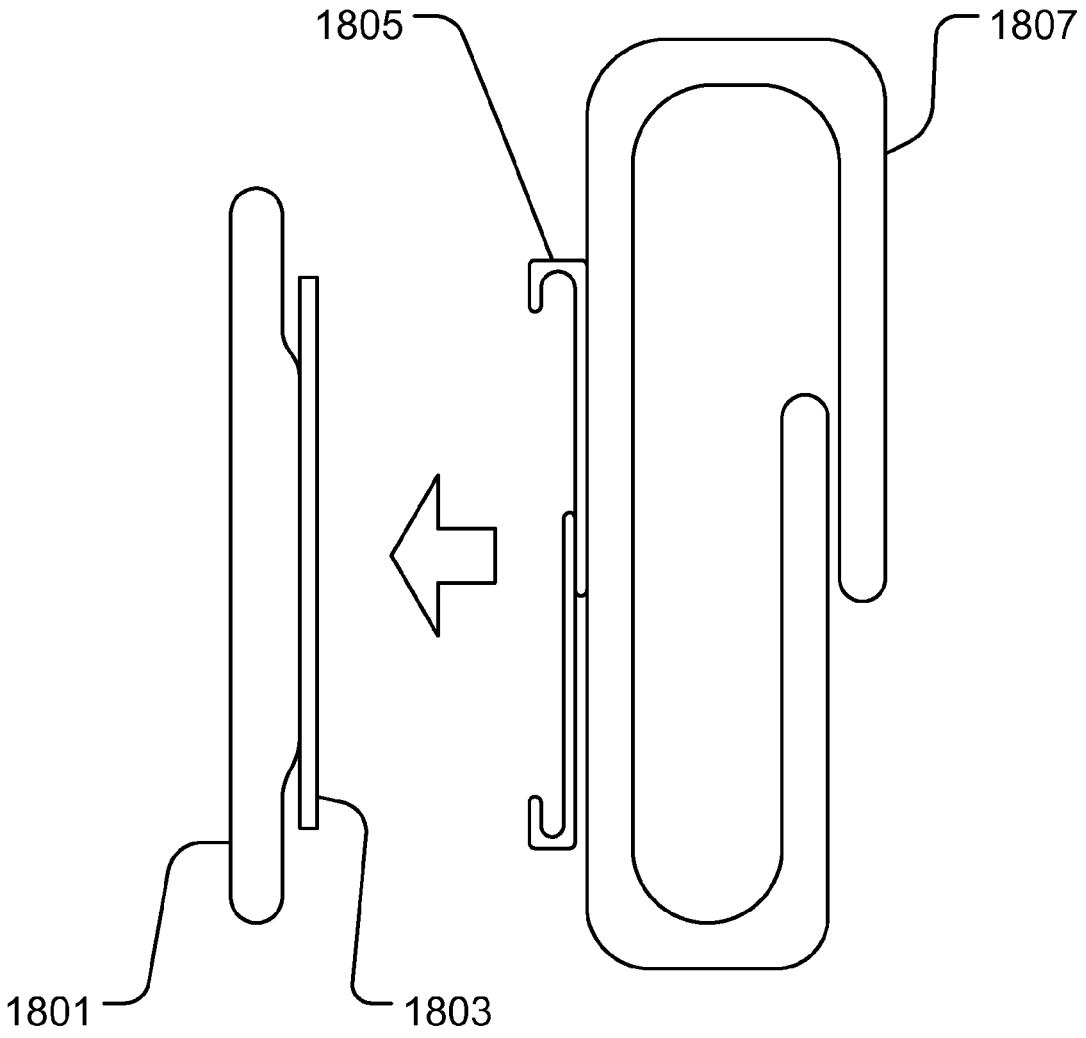
FIG. 18 shows a cross section view of duty belt and mounted accessory, similar to FIG. 8.

FIG. 18 shows a cross section of the belt assembly demonstrating the accessories clamping or attaching onto the edges of the rail, with the following components and features:

1801: duty belt
1803: rail
1805: clip
1807: accessory pouch.

FIG. 18 shows how they are put together (see the arrow).

Figure 19:
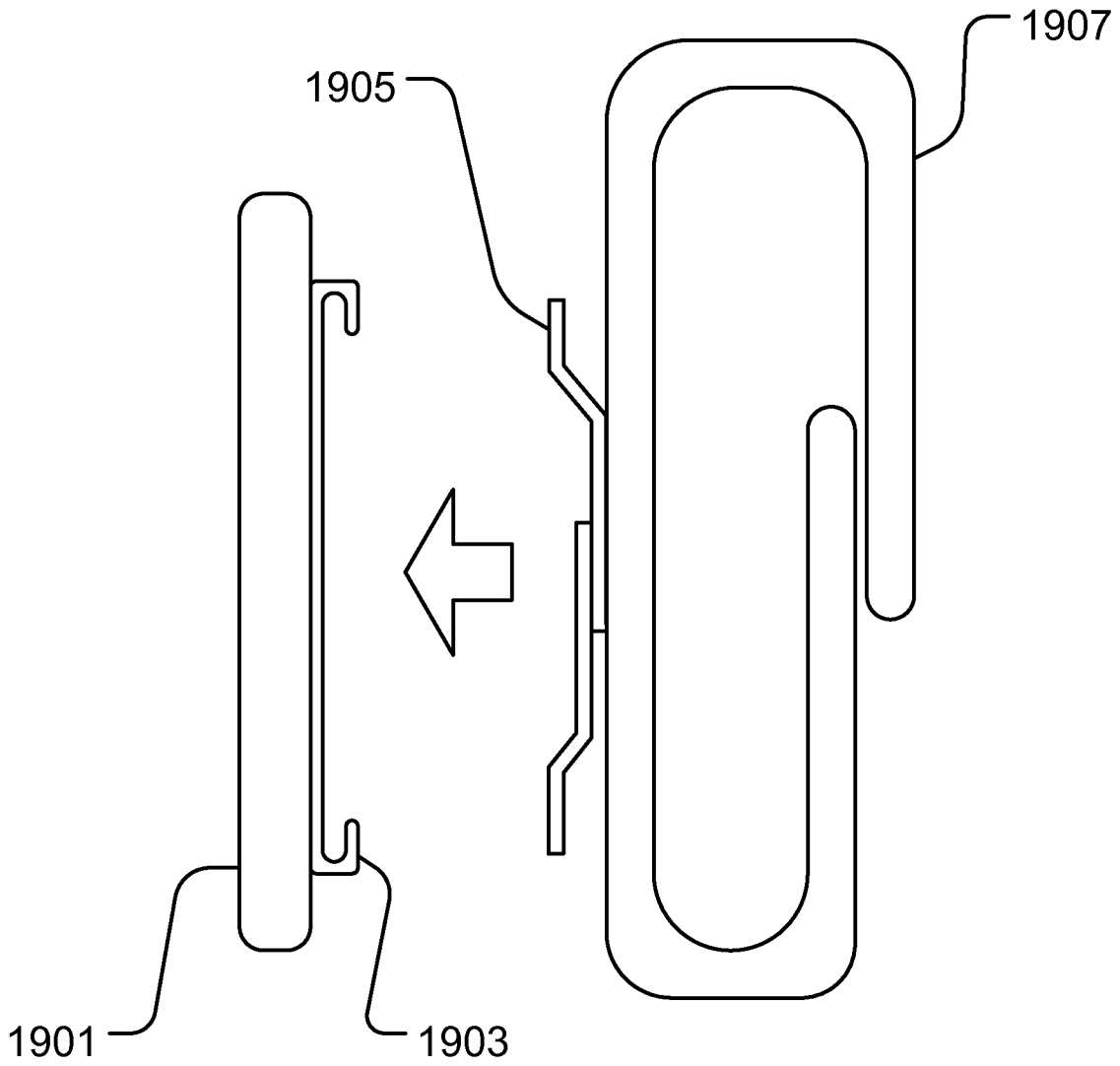
FIG. 19 shows an alternative rail configuration, similar to FIG. 11.

FIG. 19 shows a cross section of the belt assembly demonstrating an accessory attachment to the rail, in an embodiment, with the following components and features:

1901: duty belt
1903: rail
1905: clip. (Note that the two-part clip has a slight sliding movement, so that clip 1905 can fit and attach to the rail 1903. The same is shown in FIG. 18 above, for item 1805.)
1907: accessory pouch.

FIG. 19 shows how they are put together (see the arrow).

Figure 20A:
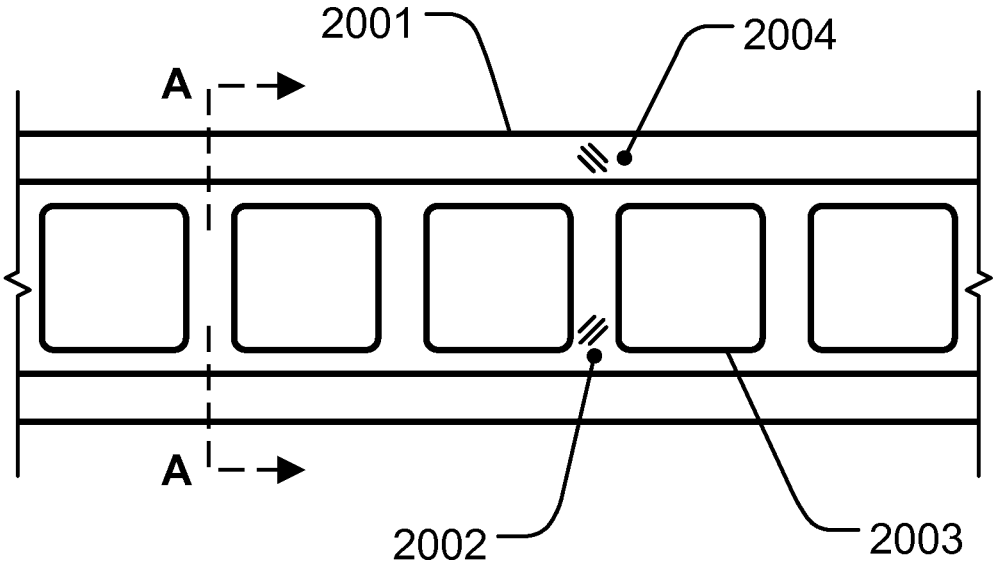
FIGS. 20*a-c* show a cosmetic piece attached in the interior of the rail, similar to FIG. 12.
Figure 20B:
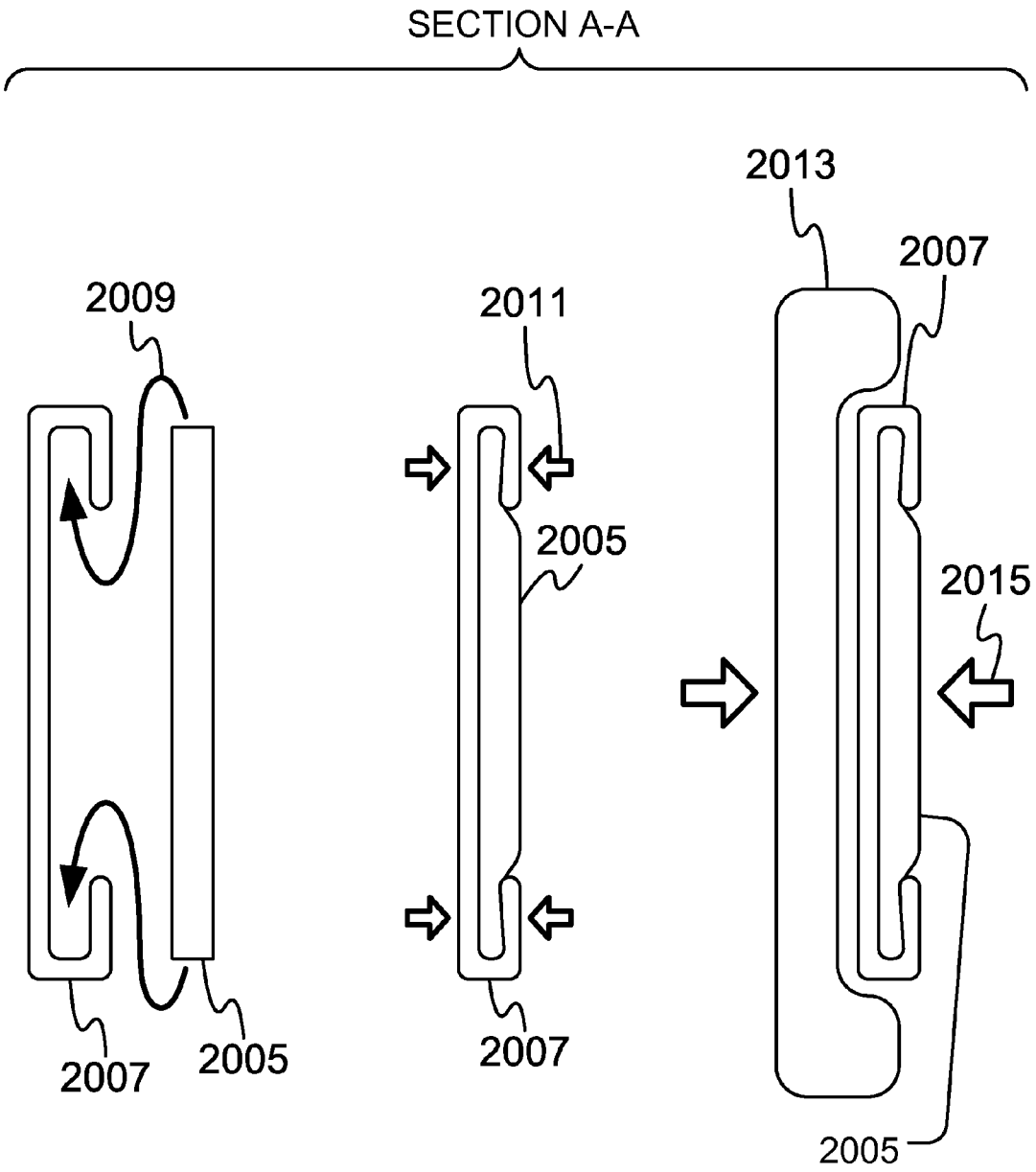
Figure 20C:
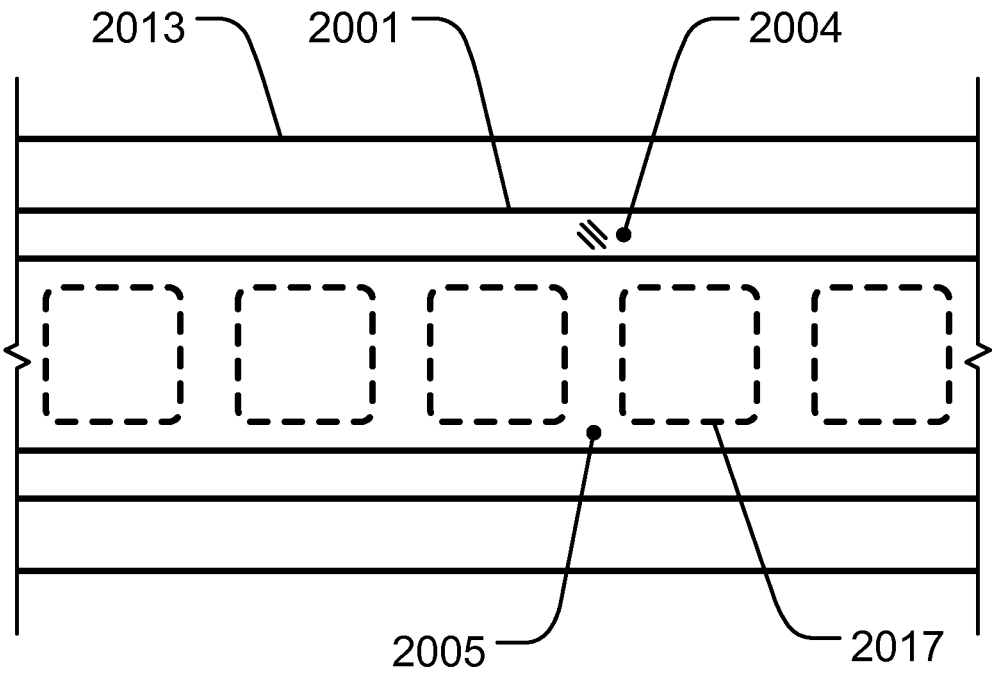

FIG. 20(*a*) shows the view of the rail with holes, e.g., to lighten the (e.g., metallic) rail, in an embodiment, with the following components and features (the view of the cross-section at A-A direction):

2001: rail
2002: surface of rail
2003: hole(s) in rail, e.g., to lighten the rail
2004: surface of rail bent over at top and bottom edges.

Please note that the width of the belt is defined as the perpendicular distance between the two letters A shown in FIG. 20(*a*).

FIG. 20(*b*) shows the cross section view of the rail with cosmetic and padding pieces, in an embodiment, with the following components and features:

2005: cosmetic piece (e.g., leather)
2007: rail (e.g., metallic)
2009: open hems allow for inserting cosmetic leather
2011: once cosmetic piece is inserted, hems can be finished off, to mechanically secure the edges of the leather.
2013: padding
2015: the padding is attached, e.g., by stitching between the padding and the cosmetic treatment through (e.g., large) rail holes.

FIG. 20(*b*) shows how they are put together (see the arrows, in the sequence, in the steps shown).

FIG. 20(*c*) is the view of the rail with cosmetic and padding pieces attached, in an embodiment, with the following components and features:

2001: rail (e.g., 1.5" wide)
2004: surface of rail, bent over at top and bottom edges, on cosmetic piece
2005: surface of cosmetic piece
2013: padding (e.g., 2.25" wide)
2017: stitching between padding and cosmetic piece, e.g., through holes in the rail.

Figure 21:
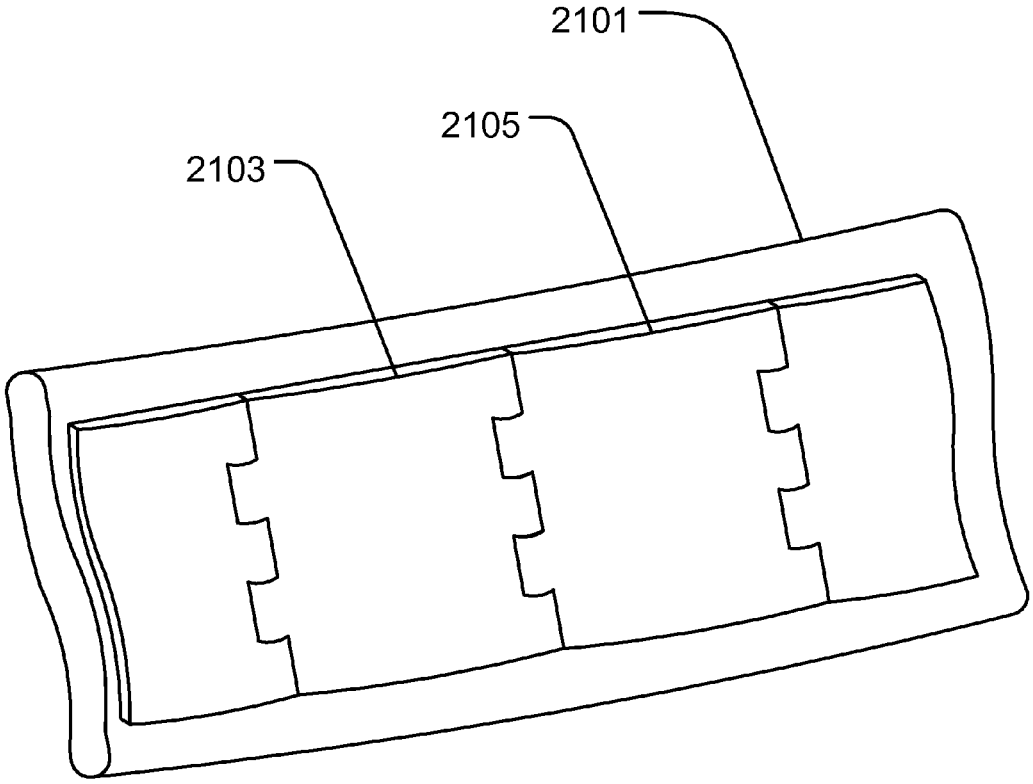
FIG. 21 shows a segmented rail, similar to FIG. 14.

FIG. 21 shows a section of duty belt, demonstrating segmented rail, in an embodiment, with the following components and features:

2101: duty belt
2103, 2105: rail segments.

Figure 22:
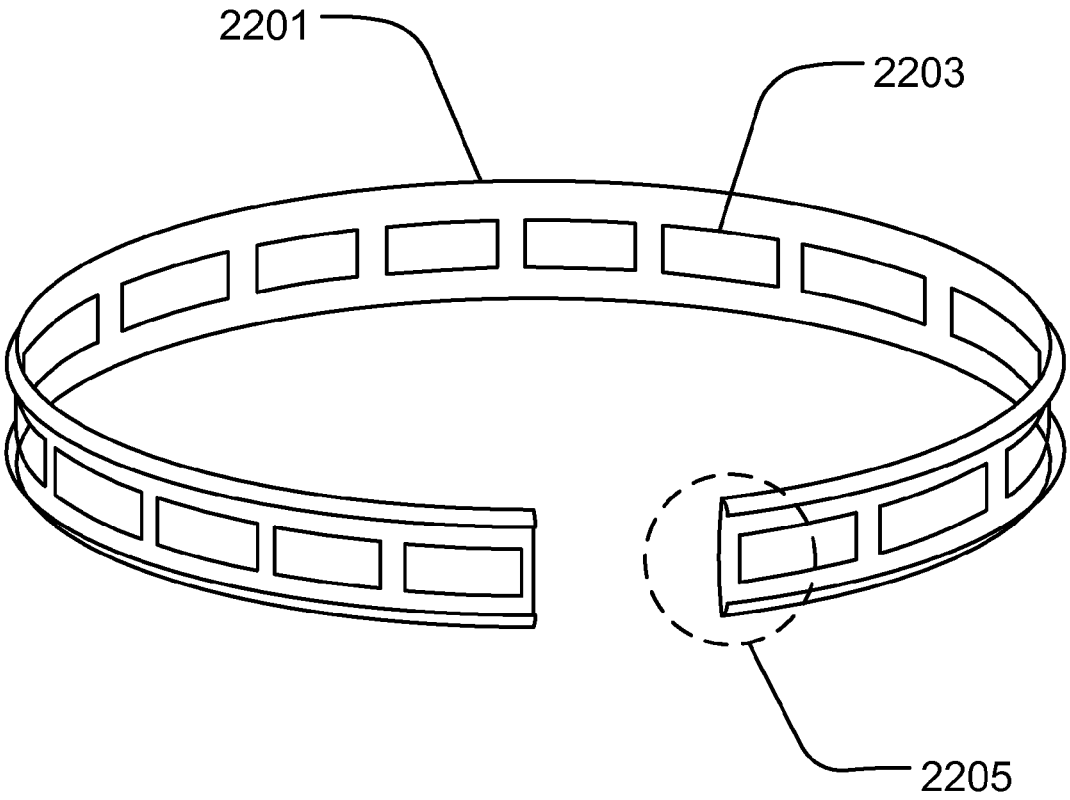
FIG. 22 shows a pre-formed rail, similar to FIG. 15.

FIG. 22 shows a view of the rail, pre-formed into shape, prior to assembly, in an embodiment, with the following components and features:

2201: rail
2203: e.g., hole(s) in the rail
2205: demonstrating top and/or bottom edge(s) of the rail, bent over.

With the rail preformed into shape, it has a less tendency to kink when putting it on, in one embodiment. This allows/demands unique pop display, which separates it from other types of belts. It also allows for marketing distinctions, e.g., "People are not flat, and thus, belts should not be." The form factor is comfortable and customizable for users of different size/shape. This is the first example of a platform where the rail is angled, as moving around the body.

Figure 23A:
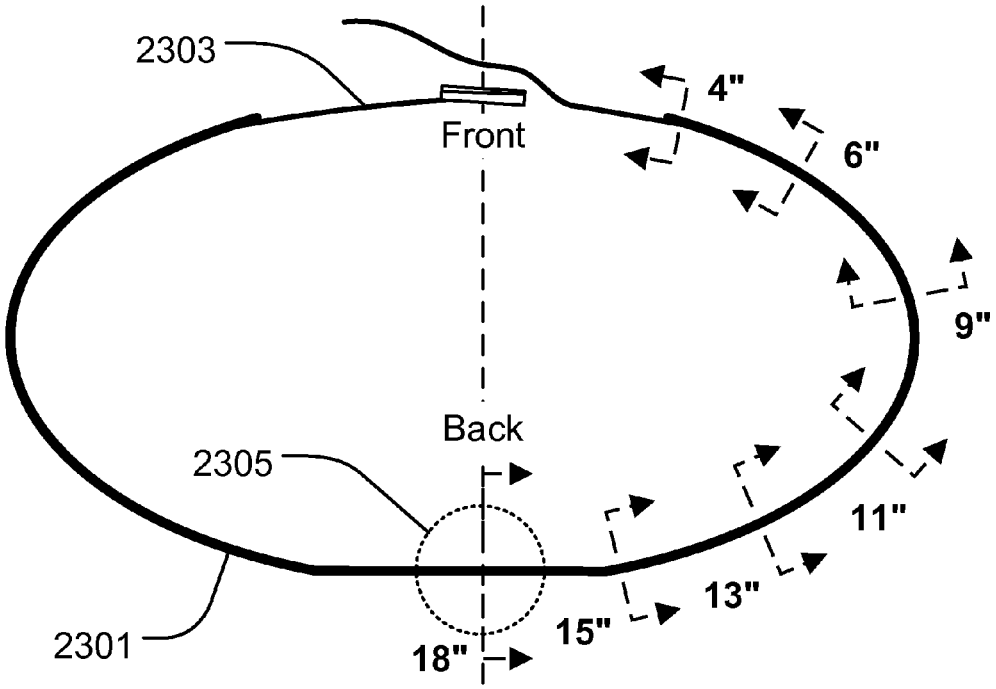
FIGS. 23*a-b* show a pre-formed rail with a variety of curvatures and flaring, similar to FIG. 16.
Figure 23B:
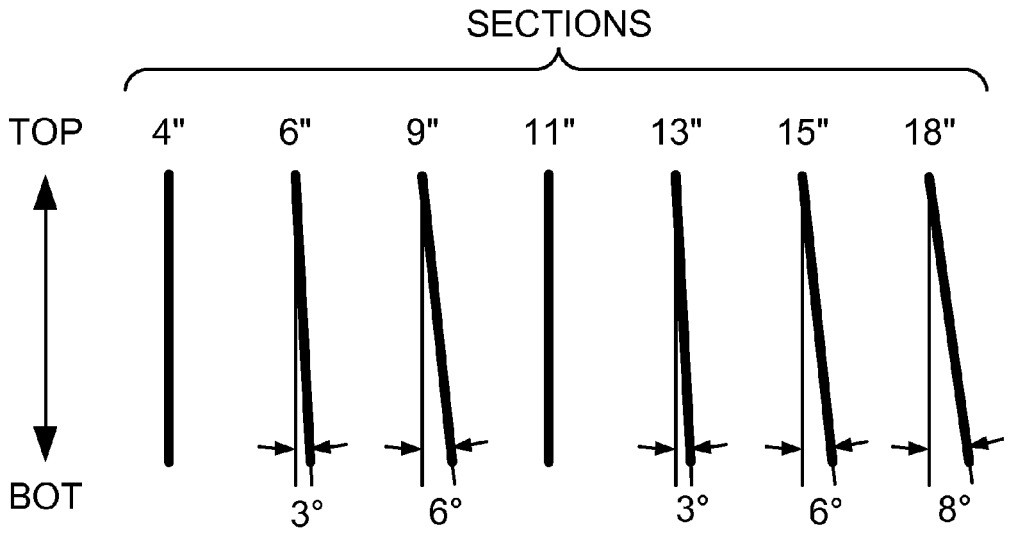

FIG. 23(*a*) is the top view of a pre-formed rail demonstrating various curvatures, in an embodiment, with the following components and features:

2301: rail
2303: e.g., strap and/or buckle in front region, instead of rail.
2305: e.g., small or no curvature at the back portion.

FIG. 23(*b*) shows the section view of a pre-formed rail demonstrating various flaring. In one embodiment, the bottom of the rail flairs out, to match the body contours. The flaring angles are provided as an example from a specific user (in an embodiment), taken at various locations, e.g., measured from the front, around to the back. In one embodiment, the padding also changes as it goes around the body, e.g., in order to spread out the hot spots (e.g., on pelvic bones). This configuration is very flexible and comfortable for the user.

For different embodiments, the components of the belt and/or buckle could be mechanically, thermally, sewn, pressed, heated, chemically, inset-molded, co-molded, glued, banded together, chained together, hooked, hook-and-looped, attached using Velcro, or otherwise, integrated or attached to each other, to the belt, or to the buckle. The components can be integrated as part of a belt or buckle. Or, it can be another piece, added to a belt or buckle, as a separate piece. The belt or buckle may have one or more layers or shells. The components may have a notch or lip(s), to attach to the belt or buckle.

Or, one can use glue, screw, pin, small bar, or spring, to attach the components to the belt or buckle.

The material used for the belt or buckle can be selected from the following list (or their combinations): plastic, leather, silk, polyester, string, chain, elastic material, rubber, any artificial material, rigid, soft, flexible, wood, glass, smooth, rough, coarse material or surface, metal, alloy, nylon, cotton, wool, fabric, ceramic, porcelain, china, baked clay, oil or petroleum product, artificial material, natural material, convex, concave, or flat surface, transparent, translucent, or opaque material, uniform, non-uniform surface, reflective surface, or absorptive surface.

Any variations of the above teaching are also intended to be covered by this patent application.

The invention claimed is:

1. A duty belt system, said duty belt system comprising:

a belt having a width;

a buckle; and one rectangular rail mounted on exterior of said belt;

wherein said one rectangular rail is positioned in a middle of said width of said belt, along a length of said belt;

wherein said one rectangular rail comprises multiple holes along a length of said one rectangular rail;

wherein said one rectangular rail is flexible along said one rectangular rail's length;

wherein more than one accessories are attached to said one rectangular rail;

wherein said belt comprises cosmetic treatments;

wherein said cosmetic treatments extend through said multiple holes along said one rectangular rail's length;

wherein said one rectangular rail is positioned in such a way with respect to said belt that there are two gaps at two edges of said one rectangular rail, along a width of said one rectangular rail;

wherein said more than one accessories each have a hook, wherein said hooks are attached to said one rectangular rail at said two gaps.

2. The duty belt system as recited in claim 1, wherein said one rectangular rail is made of metal, fiber-epoxy composite, thermoset polymer or thermoplastic polymer.

3. The duty belt system as recited in claim 1, wherein at least a portion of an inner surface of said belt has a surface treatment comprised of one half of a hook-and-loop fastener assembly.

4. The duty belt system as recited in claim 1, said duty belt system further comprises breathable material.

5. The duty belt system as recited in claim 1, wherein a cosmetic piece is affixed to said one rectangular rail.

6. The duty belt system as recited in claim 1, wherein a cosmetic piece is extended as an integral part of ends of said belt.

7. The duty belt system as recited in claim 1, wherein said one rectangular rail is pre-formed prior to assembly to fit a person's body.

8. The duty belt system as recited in claim 1, wherein said one rectangular rail has a cross section that is configured to match curvature of a person's body.

9. The duty belt system as recited in claim 1, wherein said one rectangular rail has flaring or variable flaring.

10. The duty belt system as recited in claim 1, wherein an upper edge of said one rectangular rail flares outward, configured to be close to front of a user's body.

* * * * *